US006845640B2

(12) United States Patent
Loeff et al.

(10) Patent No.: US 6,845,640 B2
(45) Date of Patent: Jan. 25, 2005

(54) QUICK-RELEASE LOCKABLE LONG GUN CASE

(75) Inventors: Thomas Loeff, Phoenix, AZ (US); Gary Myers, Monee, IL (US); Calin Vasile Roatis, Des Plaines, IL (US); Catalin Captarencu, Wheeling, IL (US)

(73) Assignee: Advanced Security Products, LLC

( * ) Notice: Subject to any disclaimer, the term of this patent is extended or adjusted under 35 U.S.C. 154(b) by 0 days.

(21) Appl. No.: 10/288,433

(22) Filed: Nov. 6, 2002

(65) Prior Publication Data

US 2004/0083778 A1 May 6, 2004

(51) Int. Cl.[7] ..... B65D 55/14
(52) U.S. Cl. ..... 70/63; 42/70.11; 109/45
(58) Field of Search ..... 70/14, 57, 58, 70/63; 109/45, 47, 50–52, 59 R; 42/70.01, 70.04–70.06, 70.11

(56) References Cited

U.S. PATENT DOCUMENTS

| | | | | | |
|---|---|---|---|---|---|
| 1,513,267 | A | * | 10/1924 | Parks | 42/70.11 |
| 3,307,755 | A | * | 3/1967 | Lentz | 206/317 |
| 4,099,593 | A | * | 7/1978 | Schultz | 180/289 |
| 4,651,544 | A | * | 3/1987 | Hungerford | 70/63 |
| 4,854,145 | A | * | 8/1989 | Arai et al. | 70/250 |
| 5,009,088 | A | * | 4/1991 | Cislo | 70/63 |
| 5,048,682 | A | * | 9/1991 | Taylor | 206/317 |
| 5,111,755 | A | * | 5/1992 | Rouse | 109/25 |
| 5,138,786 | A | * | 8/1992 | Fischer | 42/70.11 |
| 5,161,396 | A | * | 11/1992 | Loeff | 70/63 |
| 5,172,575 | A | * | 12/1992 | Fisher | 70/63 |
| 5,189,894 | A | * | 3/1993 | Buck | 70/63 |
| 5,236,086 | A | * | 8/1993 | MacTaggart | 206/317 |
| 5,621,996 | A | * | 4/1997 | Mowl, Jr. | 42/70.07 |
| 5,662,219 | A | * | 9/1997 | Tschudy et al. | 206/317 |
| 5,768,819 | A | * | 6/1998 | Neal | 42/96 |
| 5,794,466 | A | * | 8/1998 | Hungerford et al. | 70/63 |
| 5,881,584 | A | * | 3/1999 | Brunoski et al. | 70/68 |
| 6,009,654 | A | * | 1/2000 | Williams et al. | 42/70.11 |
| 6,438,885 | B1 | * | 8/2002 | Murray et al. | 42/70.07 |
| 6,510,642 | B2 | * | 1/2003 | Riener | 42/70.11 |
| 6,533,149 | B2 | * | 3/2003 | Vor Keller et al. | 224/244 |
| 6,568,117 | B2 | * | 5/2003 | Weinraub | 42/70.11 |
| 6,578,307 | B2 | * | 6/2003 | Troyer | 42/70.06 |
| 6,584,719 | B1 | * | 7/2003 | Morford | 42/94 |
| 2003/0024283 | A1 | * | 2/2003 | Meyer | 70/63 |

* cited by examiner

*Primary Examiner*—Suzanne Dino Barrett
(74) *Attorney, Agent, or Firm*—H. Jay Spiegel

(57) ABSTRACT

A quick-release lockable long gun case encloses the breech, trigger guard and trigger of a long gun allowing the barrel and stock to protrude through oppositely disposed openings. A keypad may be preprogrammed with a combination that must be entered to allow access to the long gun. A key operated override mechanism is also provided. An internal chamber contains a removable insert having the outer configuration conforming to the breech, trigger guard and trigger of the long gun. The lid is hinged to the body with a spring biasing the lid in the direction of opening. The latch mechanism includes a strike attached to the lid of the long gun case and a latch mounted within the body of the long gun case. The latch is pivotable and has upper and lower structures that are balanced about the pivot point thereof. The pull points used to actuate the latch are misaligned with respect to the pivot axis of the latch so that if the long gun case is dropped or jostled, such actions will not result in undesired opening of the lid. Two alternative actuating mechanisms are provided, a motor provided with a cable windable around the shaft of the motor, and a rotatable actuator rotated when a proper key is received within a keyhole.

36 Claims, 10 Drawing Sheets

QUICK-RELEASE LOCKABLE LONG GUN CASE

BACKGROUND OF THE INVENTION

The present invention relates to a quick-release lockable long gun case. In the prior art, gun safes are known. Applicant is the patentee in U.S. Pat. No. 5,161,396, issued Nov. 10, 1992, and claiming a tamper proof lockable firearm case. In the '396 patent, a gun safe is disclosed that is intended to completely enclose a handheld firearm such as a pistol. There is no teaching or suggestion in the '396 patent of enclosing the breech and trigger of a long gun such as a rifle or shotgun with the barrel and stock extending out opposed openings in the case as is the case with the present invention.

Applicant is also the patentee of U.S. Pat. No. D 417,335, issued Dec. 7, 1999, for a security container. The security container claimed in the '335 patent includes opposed openings as well as a keypad. There is no teaching or suggestion in the '335 patent as to precisely which components of a rifle are enclosed therewithin and which components protrude outwardly therefrom. Additionally, the inner workings of the security container of the '335 patent are nowhere taught or suggested.

The firearm case disclosed and claimed in Applicant's prior U.S. Pat. No. 5,161,396 has become a commercially successful product, sold under the registered Trademarks GUNVAULT®, MINIVAULT®, MULTIVAULT® and NO-EYES™. The success of these firearm cases has exposed a need for an equally effective firearm case to be used to secure a long gun such as a rifle or shotgun so that the long gun can be protected against unauthorized use while also, at the same time, being readily accessible, easily and safely transportable. It is with these needs in mind that the present invention was developed.

SUMMARY OF THE INVENTION

The present invention relates to a quick-release lockable long gun case. The present invention includes the following interrelated objects, aspects and features:

(1) In a first aspect, the present invention is intended to enclose the breech and trigger of a long gun such as a rifle or shotgun allowing the barrel and stock to protrude through oppositely disposed openings in the long gun case.

(2) A keypad is disposed on a top surface of the long gun case and associated electronic circuitry may be preprogrammed with a combination that must be entered to allow access to the long gun.

(3) In addition to the keypad, a key operated override mechanism is provided for a number of reasons including (a) in the event the owner has forgotten the combination, and (b) in the event the battery power for the internal circuitry is disabled or drained.

(4) The long gun case has an internal chamber that contains a removable insert having the outer configuration conforming to the breech, trigger guard and trigger of the long gun that is to be releasably retained therein. This removable insert may be interchanged with one or more alternative removable inserts having an indentation corresponding to the outer configuration of the breech and trigger guard of other examples of long guns. As an alternative, if desired, the internal recess of the insert may have walls, the configuration of which is adjustable, to accommodate to long guns having differing configurations of breech and trigger.

(5) Access to the internal chamber is gained through release of a lid. The lid is hinged to the body of the long gun case with the hinge including strong springs biasing the lid in the direction of opening. Thus, when the latch mechanism of the present invention is released, the springs quickly open the lid, thereby allowing access to the long gun.

(6) The latch mechanism includes a strike attached to the lid of the long gun case and a latch mounted within the body of the long gun case including a guide opening that receives the strike therethrough when the long gun case is locked in the latched (closed) configuration.

(7) The latch is pivotable and has upper and lower structures that are balanced about the pivot point thereof. The pull points that are used to actuate the latch are misaligned with respect to the pivot axis of the latch so that if the long gun case is dropped or jostled, such actions will not result in undesired opening of the lid.

(8) In order to activate the latch and release the strike, two alternative actuating mechanisms are concurrently provided. In a first such mechanism, a motor is provided with a cable that may wind around the driven shaft of the motor, with the other end of the cable attached to the latch at an upper end thereof misaligned with the pivot point. The alternative actuator consists of a rotatable actuator that may be manually rotated when a proper key is received within a keyhole.

(9) The motor actuator is interconnected into an electrical circuit (not shown) that receives signals from the keypad indicative of the entry of a sequence of depressions of the keypad buttons and, when the proper combination is entered, the motor is activated to pull the cable taut and pivot the latch to a position in which it no longer captures the strike, whereupon the spring biased lid pops open. The alternative actuator is operated when the proper key is received within the keyhole and the key is rotated to rotate a tab to which an additional cable is attached, the other end of which is attached at a location on the latch opposed to the location where the motor cable is attached. Rotation of the tab pulls the latch to a position releasing the strike. The latch is spring-biased to the latched position with a torsion spring.

As such, it is a first object of the present invention to provide a quick-release lockable long gun case.

It is a further object of the present invention to provide such a case in which the breech, trigger guard and trigger of a long gun such as a rifle or shotgun are enclosed to prevent unauthorized use thereof.

It is a yet further object of the present invention to provide such a case including a handle as well as a shoulder strap facilitating carrying of the case with a long gun enclosed therein.

It is a still further object of the present invention to provide pins permitting a carrying strap to be attached to the case.

It is a still further object of the present invention to provide such a case in which a latch may be activated, either through a motor or through insertion of a key into a keyhole.

It is a still further object of the present invention to provide such a case in which cables are used to transmit force from a motor or manually key-activated actuator for the latch.

It is a still further object of the present invention to provide such a latch which is weight balanced about a pivot point to preclude unauthorized and undesired opening of the case.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
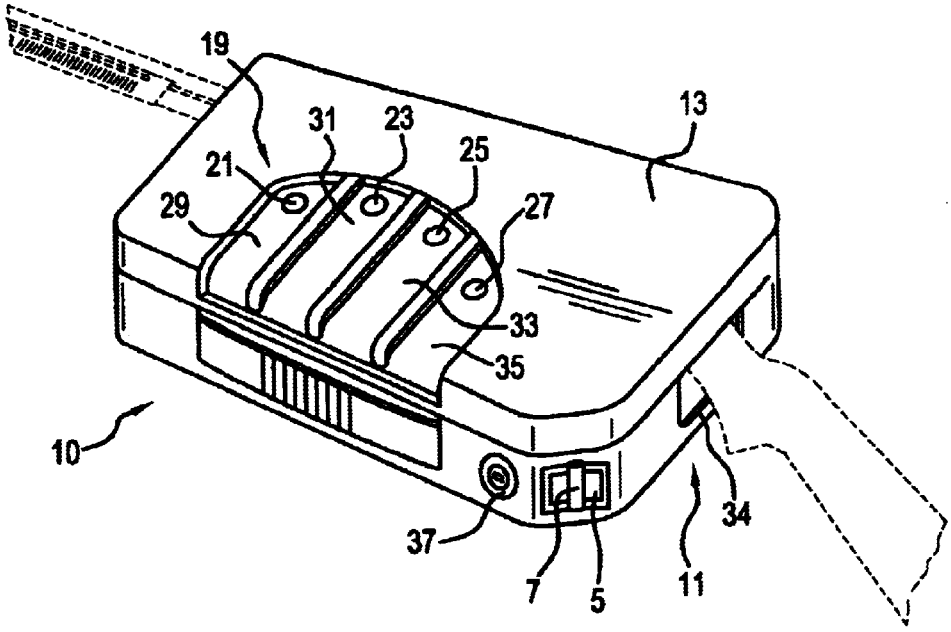
FIG. 1 shows a first perspective view of the present invention.
Figure 2A:
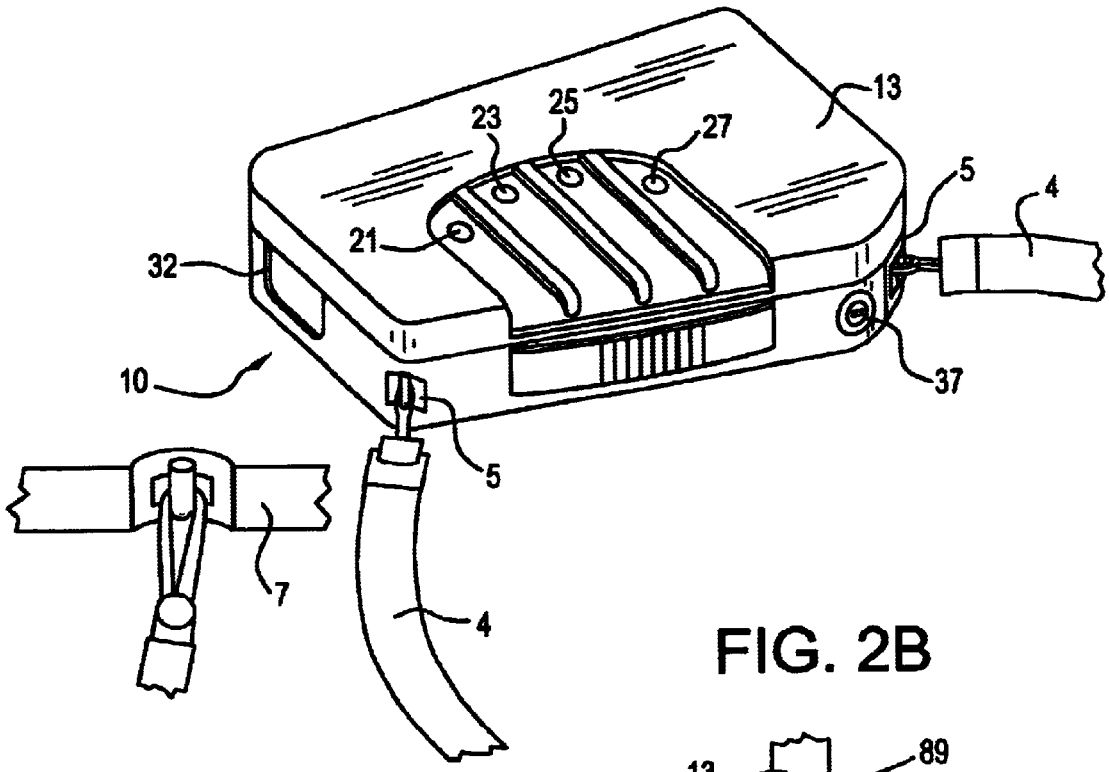
FIG. 2*a* shows a second perspective view of the present invention from a different perspective from that of FIG. 1.
Figure 2B:
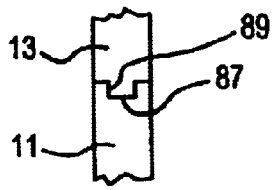
FIG. 2*b* shows a cross-sectional view along the line 2*b*—2*b* of FIG. 2*a*.
Figure 3:
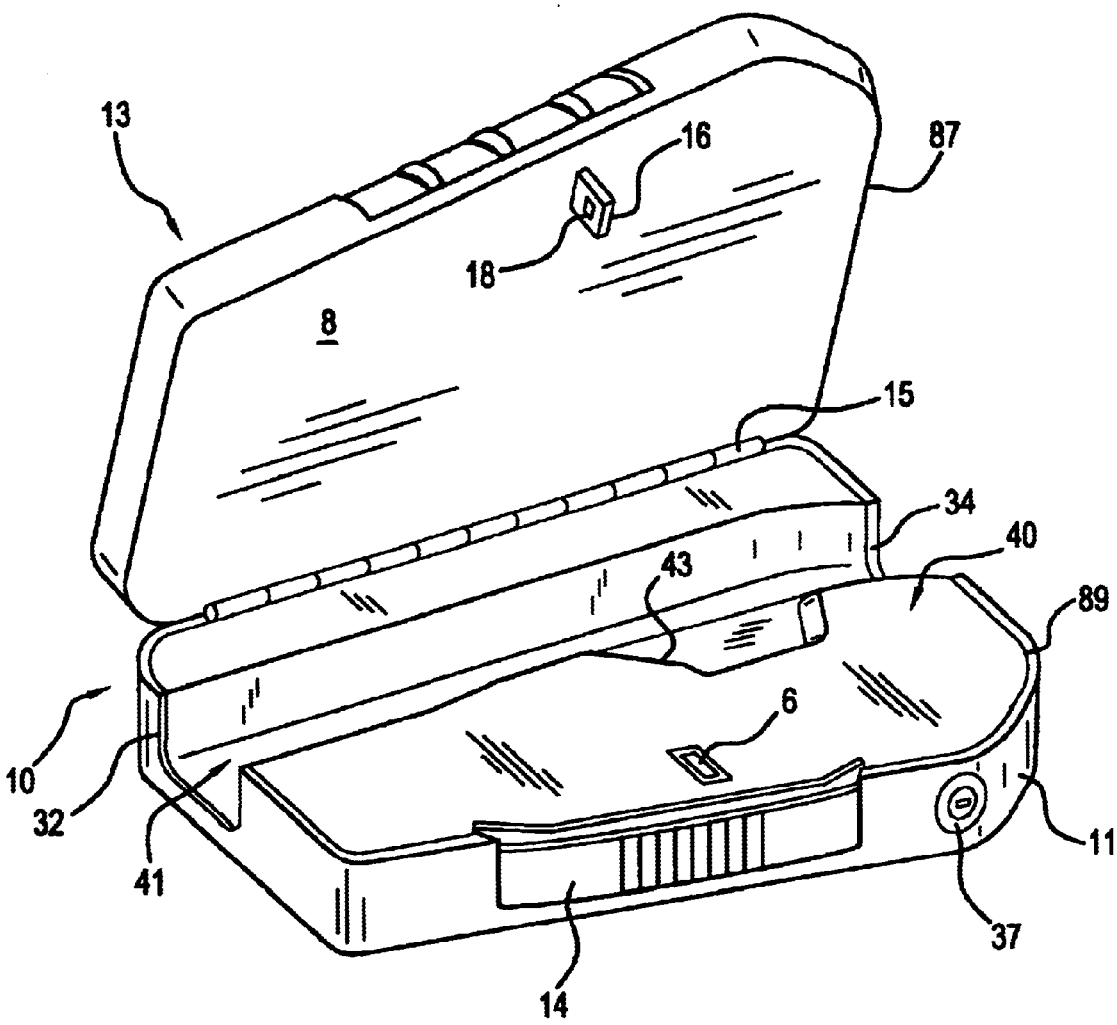
FIG. 3 shows a perspective view of the present invention similar to that of FIG. 2 but with the lid of the inventive long gun case open.

With reference, first, to FIGS. 1–3, the present invention is generally designated by the reference numeral 10 and is seen to consist of a housing or case having a body 11 and a lid 13 pivoted to the body 11 at a hinge 15. A carrying handle 14 is installed on the base 11 and allows the user to grab the handle 14 and transport the case 10. Alternatively, or in addition to the handle 14, a shoulder strap 4 may be provided (FIG. 2*a*). As shown in FIGS. 1 and 2*a*, recesses 5 are provided in the base 11 and posts 7 are located in the recesses to receive attachment means to hold opposed ends of the strap 4 onto the base 11. As seen more particularly with reference to FIG. 13, the hinge 15 includes springs 17 which bias the lid 13 in the direction of the open position shown in FIG. 3.

As seen in FIG. 3, a strike 16 having an opening 18 depends downwardly from the undersurface 8 of the lid 13. The strike 16 is received within an opening 6 of the latching mechanism to be described in greater detail hereinafter.

With reference back to FIGS. 1 and 2*a*, the lid 13 is seen to include actuating means including a keypad 19 similar to that which is shown in Applicant's prior patents, including buttons 21, 23, 25 and 27, each of which is located within a channel, with the channels being designated by the respective reference numerals 29, 31, 33 and 35.

The buttons 21, 23, 25 and 27 are interconnected into electrical circuitry (not shown) that is programmed with a desired combination of depressions of the buttons. When that combination is entered, the circuitry causes actuation of a latch releasing mechanism in a manner well known to those skilled in the art as will be described in greater detail hereinafter. The electrical circuitry of the present invention is well known in and of itself and only forms a part of the present invention in combination with the structural features thereof.

With further reference to FIGS. 1 and 2*a*, the actuating means also includes a keyhole 37 provided on the base 11 which receives an appropriate key (not shown) permitting manual override of the keypad 19. Openings 32 and 34 are provided for the barrel 3 and stock 2, respectively, of a long gun 1 (FIGS. 1 and 4).

Figure 4:
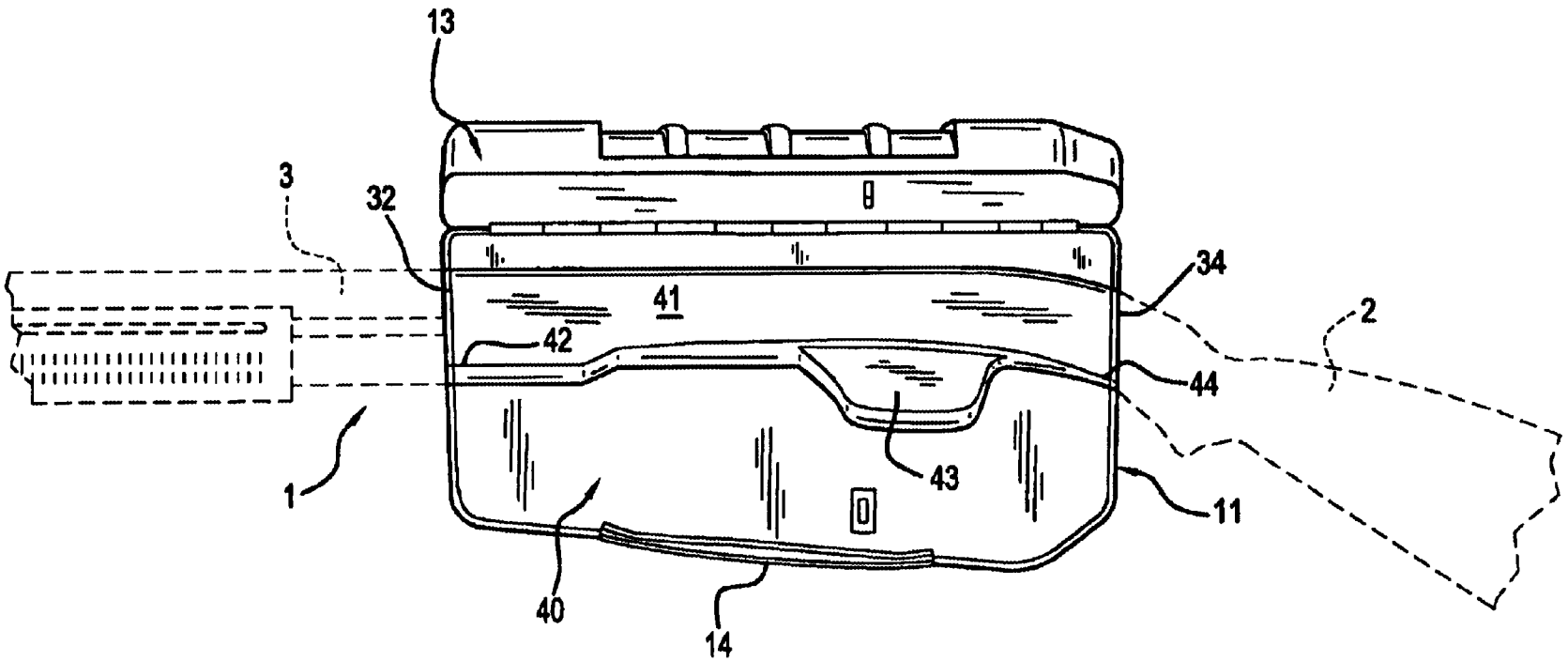
FIG. 4 shows a top view of the open long gun case.

With reference, now, to FIGS. 3 and 4, an insert 40 is received within the base 11, which is seen to include a compartment including an elongated channel 41 and a recess 43 connected to the channel 41. The channel 41 is sized and configured to receive the breech of a long gun such as a rifle or shotgun while the recess 43 is sized and configured to receive the trigger guard and trigger or other firing mechanism of the long gun. In the preferred embodiment, the insert 40 channel 41 and recess 43 are sized and configured for a particular long gun or series of long guns so that they securely fit within the channel 41 and recess 43 with little or no movement when the lid 13 is closed. Alternatively, adjustable features may be provided to allow the configuration of the channel 41 and recess 43 to be adjustable to accommodate to long guns of differing and variable configurations. Openings 42 and 44 in the insert 40 align with openings 32 and 34, respectively, in the base 11. The openings 42, 44, 32 and 34 and the channel 41 and recess 43 are sized and configured to preclude the long gun from being removed axially through the openings 42, 44, 32 and 34.

Figure 5:
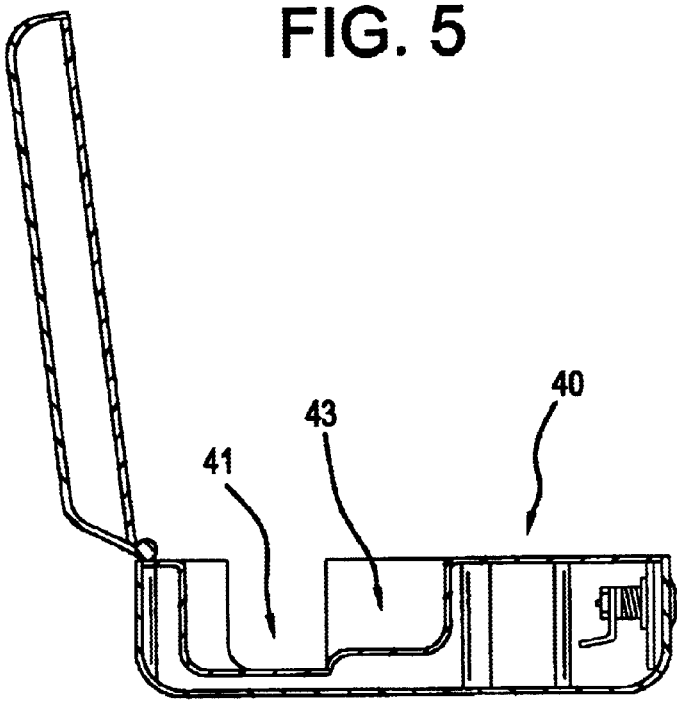
FIG. 5 shows a cross-sectional view along the line 5—5 of FIG. 4.
Figure 6:
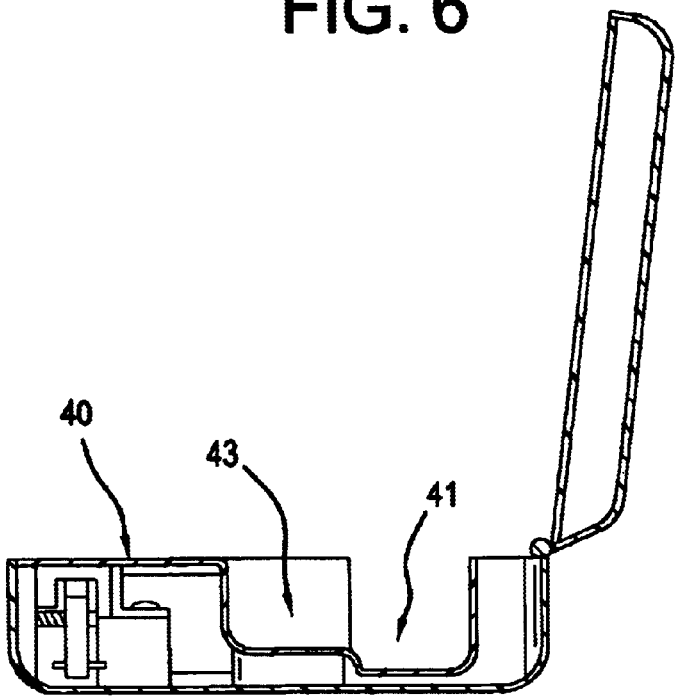
FIG. 6 shows a cross-sectional view along the line 6—6 of FIG. 4.

FIGS. 5 and 6 show various aspects of the insert 40 including the channel 41 and recess 43.

Figure 7:
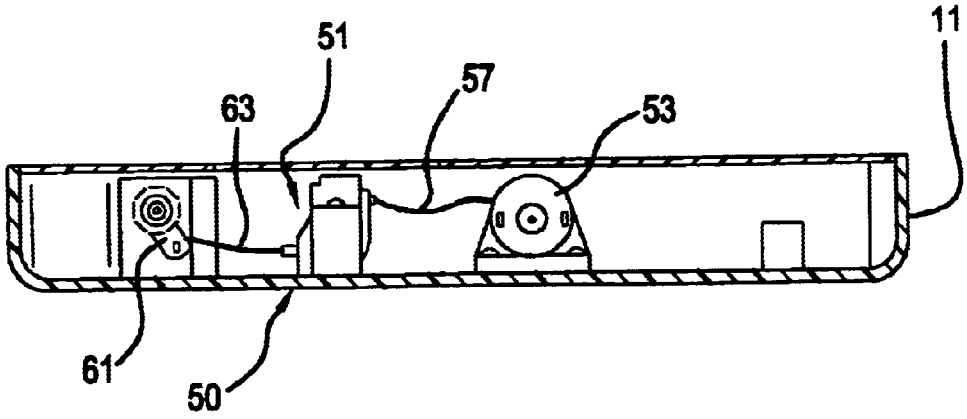
FIG. 7 shows a cross-sectional view along the line 7—7 of FIG. 4.
Figure 8:
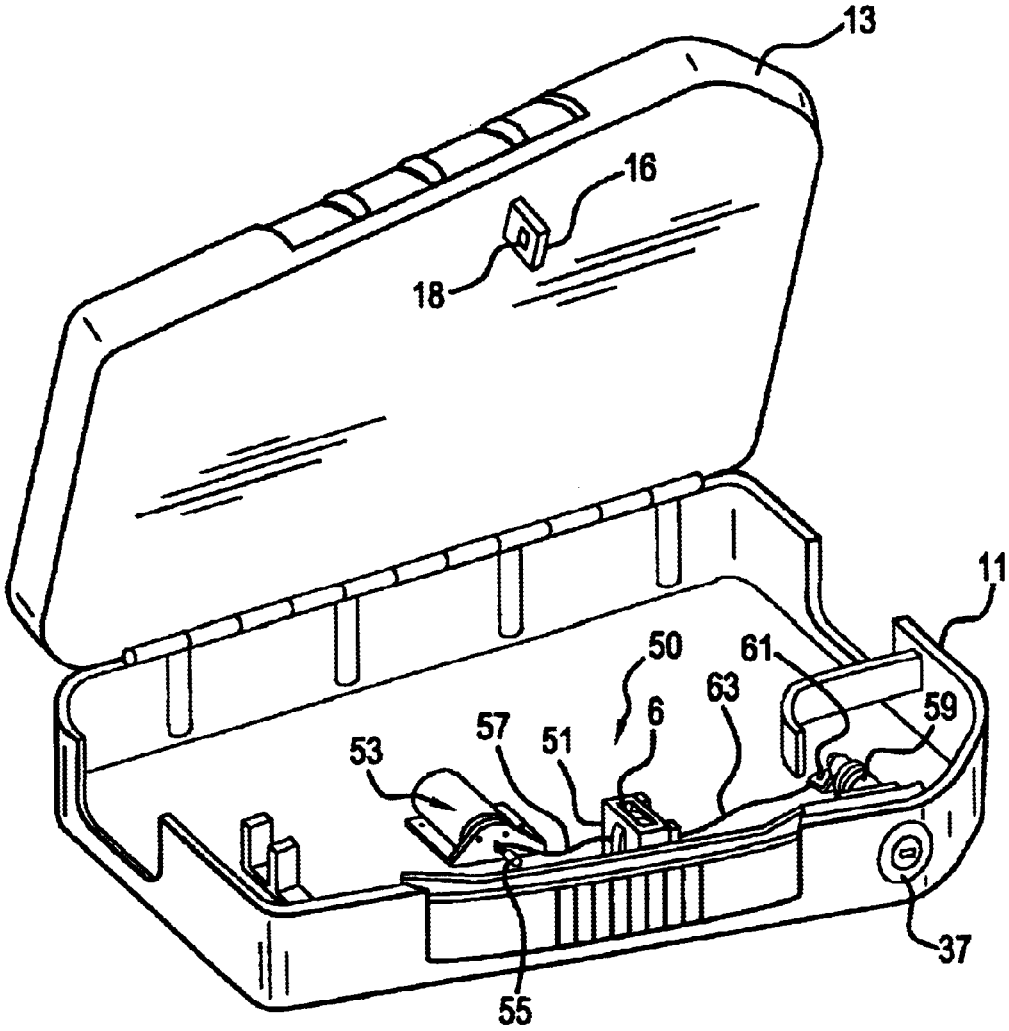
FIG. 8 shows a perspective view similar to that of FIG. 3 but with the long gun receiving insert removed to show details of the latch actuating mechanism.

With reference to FIGS. 7 and 8, placement of the latching mechanism 50 within the base 11 is shown. As seen in FIGS. 7–8, the latching mechanism includes the recess 6 formed in a catch 51 which retains a latch to be described in greater detail hereinafter. A motor 53 is controlled by the electrical circuitry (not shown) and includes a driven shaft 55 to which is attached a cable 57. The keyhole 37 leads to a rotary mechanism 59 including a cam or tang 61 to which is attached an additional cable 63.

With reference now to FIGS. 9–12 and 14, the details of the latching mechanism 50 will be better understood.

Figure 9:
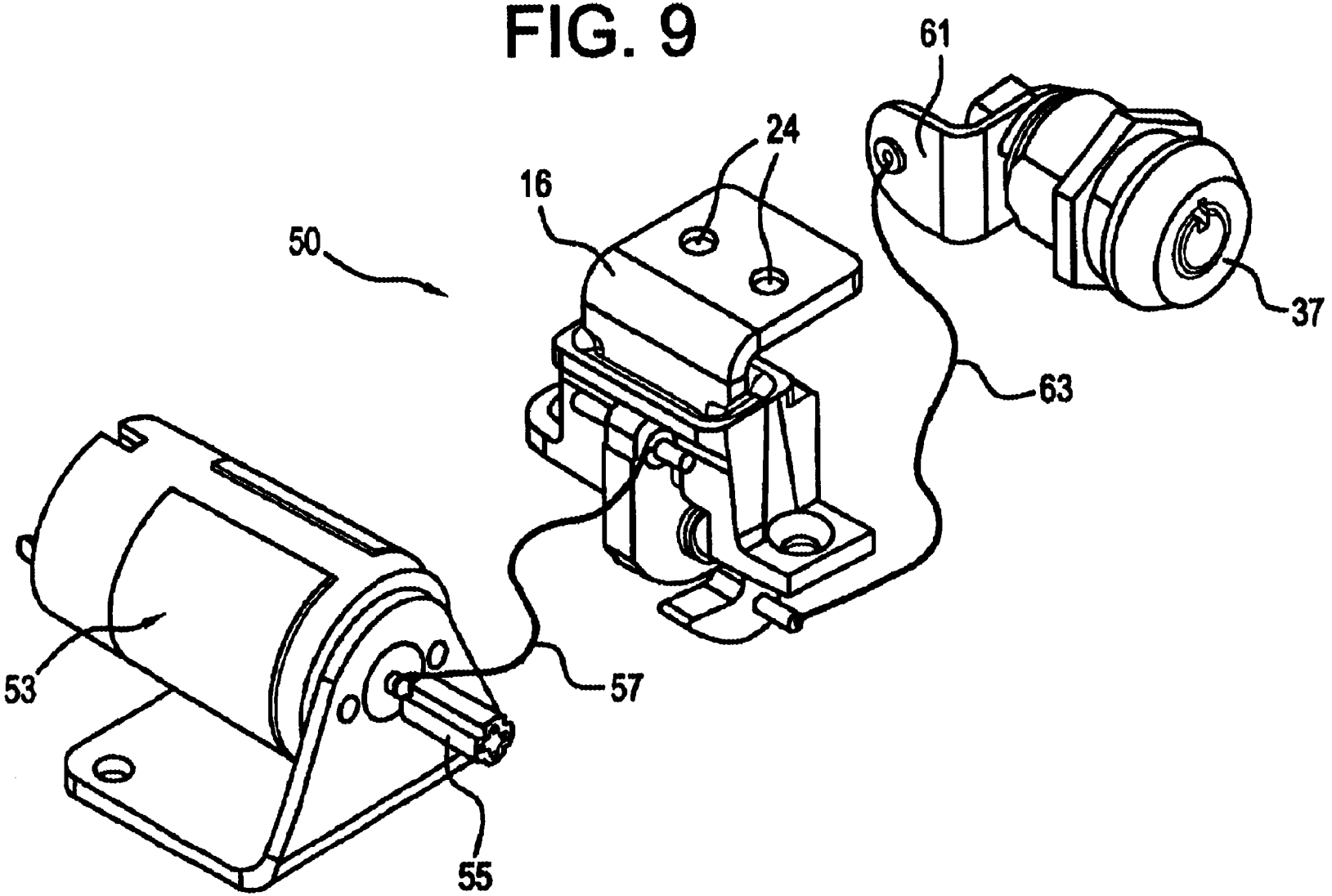
FIG. 9 shows a perspective view of the latch actuating mechanism with extraneous parts omitted to show detail.

With reference to FIG. 9, the latching mechanism 50 is seen to include the strike 16 shown with holes 24 which are used to mount the strike 16 in the lid 13 in a manner understood by those skilled in the art. The motor 53 with its drive shaft 55 are also seen as is the cable 57 mounted on the drive shaft 55 in a manner permitting the cable 57 to be wound upon the drive shaft 55 when the motor 53 is activated.

As also seen in FIG. 9, the tab or tang 61 has the cable 63 attached thereto.

Figure 10:
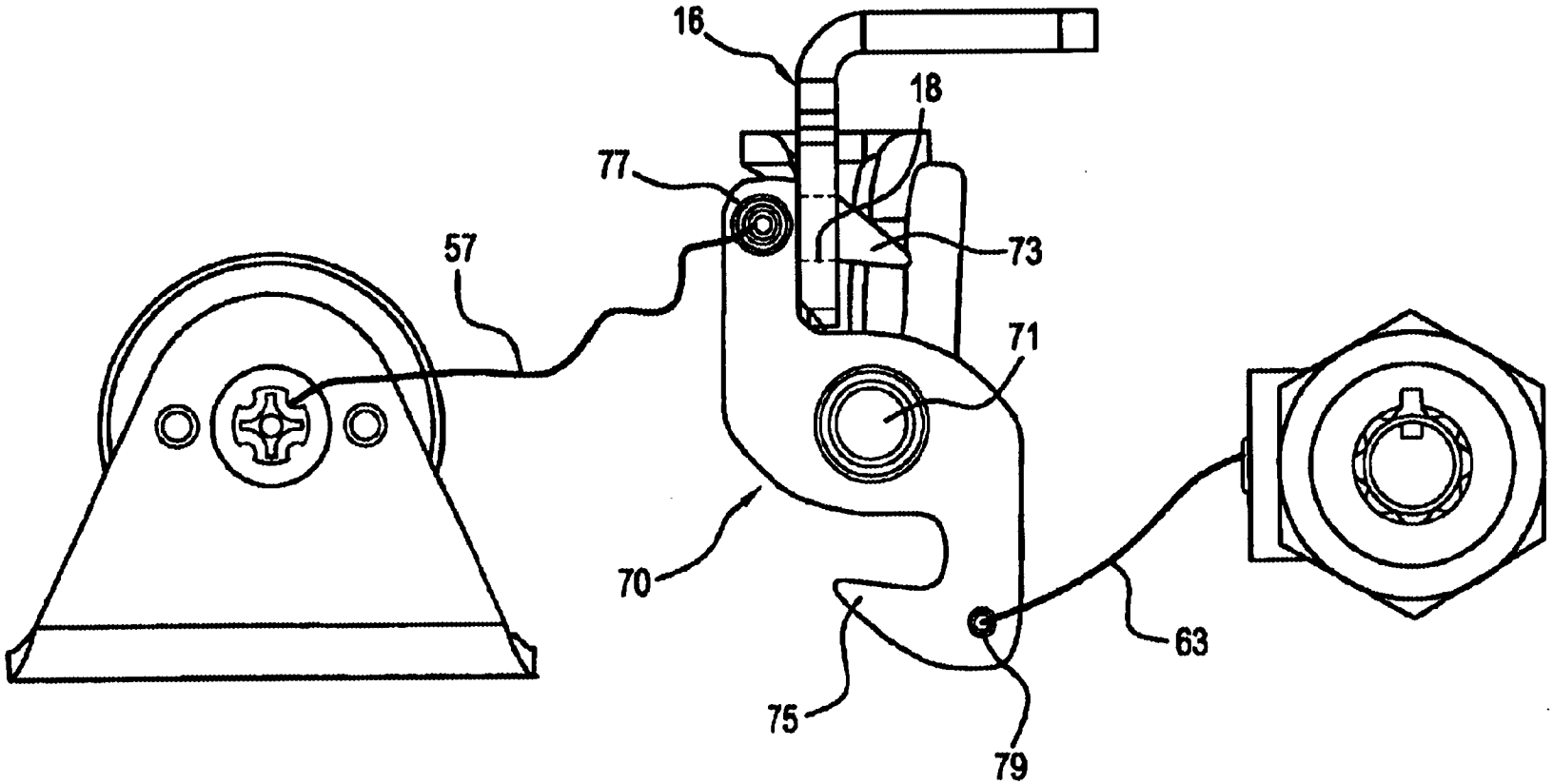
FIG. 10 shows a side view of the structure of FIG. 9 in a first orientation in which the latch is engaged.
Figure 13:
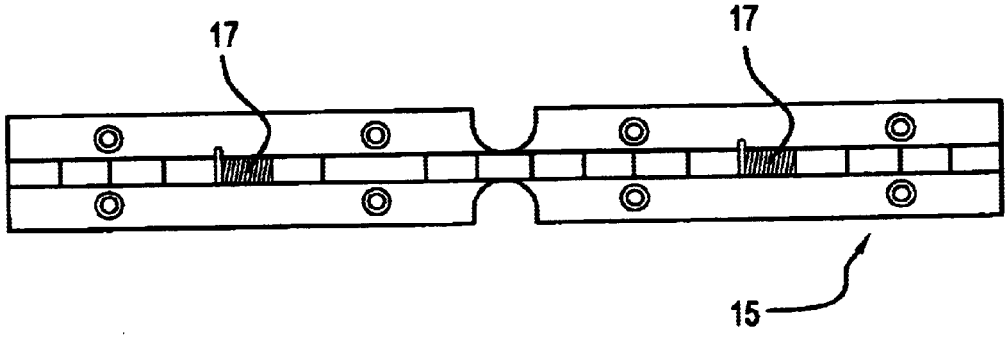
FIG. 13 shows a side view of the hinge mechanism used to bias the lid to the open position.

Reference is now made to FIG. 10 which shows in greater detail the latch 70 which is generally "S-shaped" and is pivotably mounted on a pivot pin 71. The latch 70 includes a tang 73 that extends through the opening 18 in the strike 16 (best seen in FIGS. 3 and 8) to retain the lid 13 in the closed position seen in FIGS. 1 and 2, against the opening force provided by the springs 17 (FIG. 13). A tang 75 on the bottom portion of the latch 70 is provided solely for the purpose of balancing the weight of the latch 70 so that the mass of the latch 70 is balanced about the pivot pin 71.

With further reference to FIG. 10, it is seen that the cable 57 is affixed to an attachment 77 of the latch 70 adjacent the tang 73 providing a first pull point. Similarly, the cable 63 is affixed to the latch 70 at the attachment 79 adjacent the tang 75 providing a second pull point. It is important to note that the attachments 77 and 79 are offset from the pivot pin 71 so that if the case 10 is jostled, dropped, struck or otherwise disturbed, such disturbances will not cause the latch 70 to pivot to a position allowing release of the strike 16.

Figure 14:
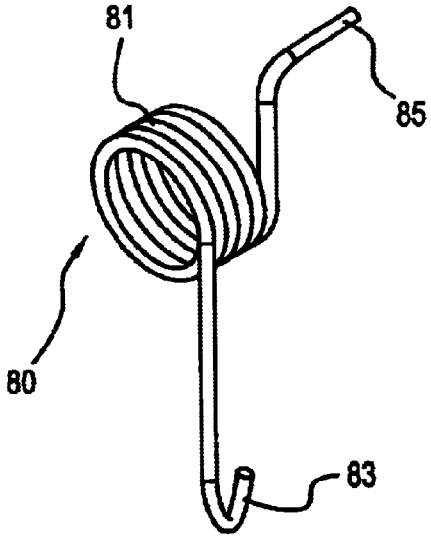
FIG. 14 shows a perspective view of a spring employed to bias the latch to the latched position.

In an additional aspect, a spring is provided wrapped about the pivot pin 71 and attached between the pivot pin 71 and the latch 70 so that the latch 70 is biased in a direction of rotation clockwise in the view of FIG. 10. The spring is designated by the reference numeral 80 and is illustrated in FIG. 14. The coils 81 of the spring are wrapped about the outer circumference of the pin 71 behind the latch 70 in the view of FIG. 10. One end 83 of the spring 80 is attached to the latch 70 while the other end 85 is attached to the pivot pin 71. The pivot pin 71 is constrained against rotation within the base 11.

Figure 11:
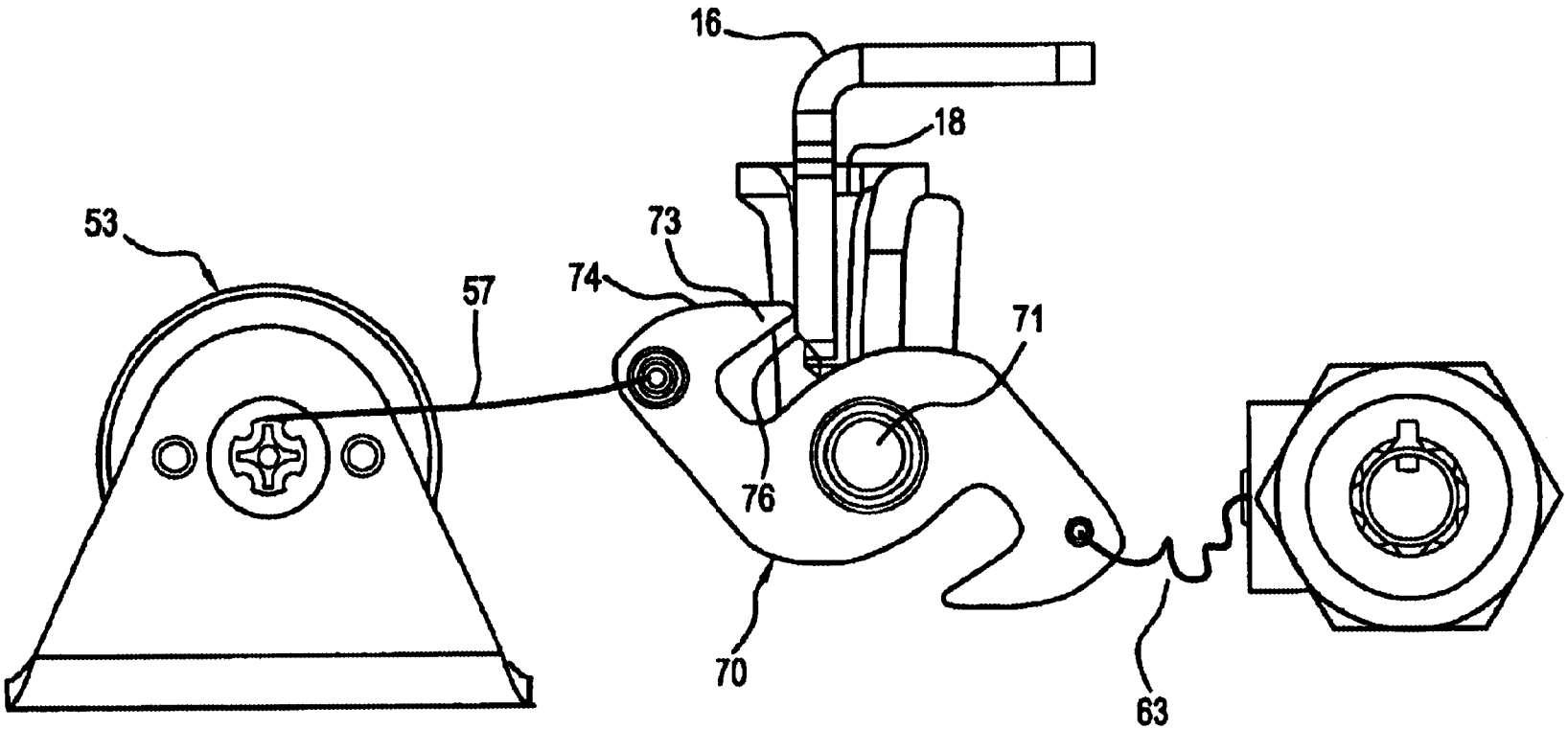
FIG. 11 shows the structure of FIG. 10 with the latch moved to the open position through operation of the motor actuator.

With reference now to FIG. 11, when the keypad 19 has been properly operated, and the preset combination has been entered therein, an electrical impulse activates the motor 53 to wind the cable 57 around the driven shaft 55, as shown in FIG. 11, thereby rotating the latch 70 about the pivot pin 71 to release the tang 73 from the opening 18 in the strike 16, whereby the springs 17 will cause the lid 13 to pivot to the position shown in FIGS. 3 and 4. When the electrical impulse is terminated, the spring 80 pivots the latch 70 back to the position shown in FIG. 10 so that when the lid 13 is pivoted to the position shown in FIGS. 1 and 2, the strike 16 will pivot the latch 70 by virtue of the interaction between angled surface 74 on the latch 70 and angled surface 76 on the strike 16 so that the latch 70 is pivoted to the position shown in FIG. 11, whereupon when the strike 16 descends slightly further, the spring 80 causes the latch 70 to rotate with the tang 73 projecting through the opening 18 in the strike 16 so that the latch 70 resumes the position shown in FIG. 10.

Figure 12:
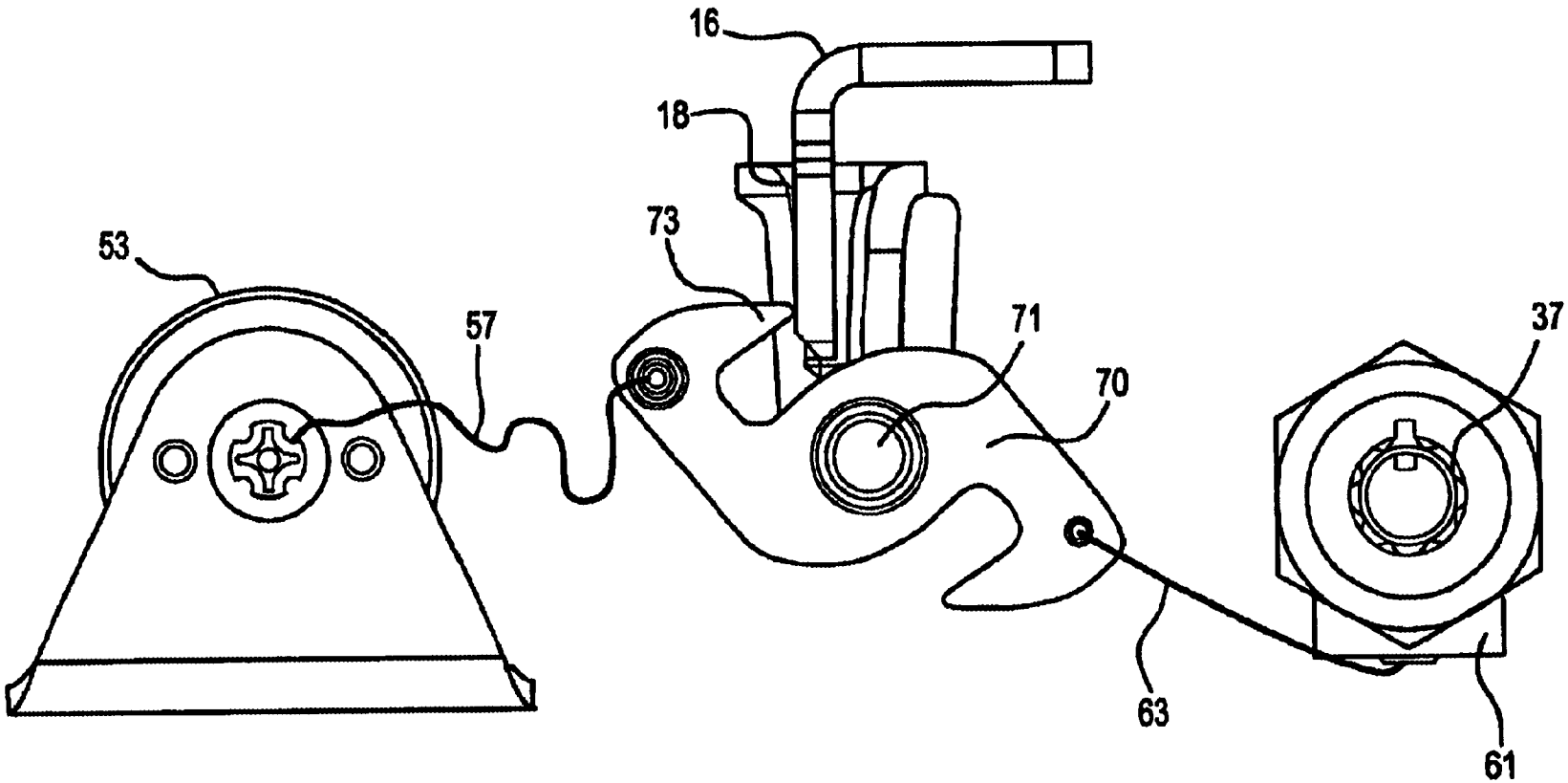
FIG. 12 shows the structure of FIG. 10 with the latch moved to the open position through operation of the manual override actuator.

With reference now to FIG. 12, under circumstances where the user has forgotten the combination on the keypad 19 that will properly activate the motor 53 and/or the batteries powering the motor 53 have discharged, a key (not shown) may be inserted into the keyhole 37 permitting rotation of the tang 61 to the position shown in FIG. 12, whereby the cable 63 pivots the latch 70 to the position shown in FIG. 12, which is the same position as shown in FIG. 11, but whereby the latch 70 has been moved to that position through rotation of the tang 61 rather than the motor 53. Under those circumstances, the result is the same, the tang 73 is removed from the opening 18 in the strike 16 and the springs 17 pivot the lid 13 of the case 10 to the position shown in FIGS. 3 and 4. When the key (not shown) is rotated back to the position seen in FIGS. 9–11, the spring 80 restores the position of the latch 70 to that which is depicted in FIGS. 9 and 10.

It is important to understand that the spring 80 is not provided to hold the latch 70 in the closed position thereof. The balance of the latch 70 as seen from the side views of FIGS. 10–12 is designed to maintain the latch 70 closed. The spring 80 is merely provided to pull the latch 70 back to the position best seen in FIGS. 9 and 10 when either of the actuators therefor are released.

Figure 15:
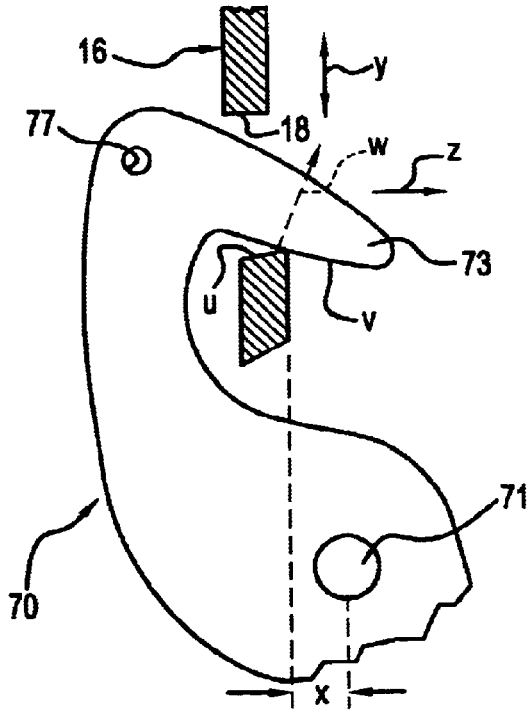
FIG. 15 shows a schematic representation of the interaction between the latch and strike.

With reference to FIG. 15, the interacting structure between the latch 70 and strike 16 is specifically designed to resist any possibility that jostling of the case 10 or prying between the base 11 and lid 13 can result in unauthorized opening of the case. As shown in FIG. 15, the latch 70 tang 73 has an undersurface "v", angularly displaced from the horizontal centerline of the case, that engages the surface "u" of the strike 16 opening 18 with the angular relationship shown. That point of engagement is laterally offset from the axis of rotation of the latch (the center of the pivot pin 71) by the distance "x". Any force exerted on the case 10 while latched is applied to the latch in the direction "w". Force applied in the direction "w" has two components, identified in FIG. 15 as "y" and "z". Because these forces are created at the interface between the surfaces "v" and "u" of the latch 70 and strike 16, respectively, spaced a distance "x" from the axis of rotation of the latch 70, a net torque force is generated that tends to rotate the latch clockwise in the view of FIG. 15, tending to maintain the latch 70 in the latched configuration shown in FIG. 15.

The magnitude of the net torque force is dependent upon (1) the magnitude of the component forces in the directions "y" and "z", (2) the angle between the engaging surfaces "v" and "u" of the latch 70 and strike 16, respectively, and (3) the horizontal and vertical distances between the axis of rotation of the latch 70 and the point of contact between the surfaces "v" and "u".

Given the strength of the force of the springs 17, it is only necessary to operate the motor 53, in that mode of operation, for several milliseconds. Once the latch 70 is removed from the opening 18 in the strike 16, the lid 13 virtually instantaneously pivots to the open position shown in FIGS. 3 and 4. Once power is removed from the motor 53, the drive shaft 55 is free to "free wheel," thereby unwinding the cable 57 under the force of the spring 80 as the latch resumes the position shown in FIG. 10.

In accordance with the teachings of the present invention, a simple actuating mechanism has been provided which is fool proof, safe and effective, and has been tested and found to be free from susceptibility of malfunction. In particular, the inventive mechanism may not be tampered with in a manner that would permit opening of the case 10 in an unauthorized fashion. In this regard, with reference to FIG. 2*b*, the lid 13 has a peripheral edge 87 that interlocks with the peripheral edge 89 in the base throughout their respective peripheries using a "tongue and groove" interaction that precludes misalignment of the lid 13 and the base 11. This interlock precludes the latch 70 from being dislodged when the lid 13 is in the position shown in FIGS. 1 and 2.

Accordingly, an invention has been disclosed in terms of a preferred embodiment thereof, which fulfills each and every one of the objects of the invention as set forth hereinabove, and provides a new and useful quick-release lockable long gun case of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A long gun case, comprising:

a) a housing including a base defining an inner chamber and a closeable lid;

b) said chamber having a compartment shaped in general conformance with an outer configuration of a breech and trigger guard of a long gun;

c) said housing having two opposed aligned openings, one of said openings adapted to receive therethrough a stock of a long gun and another of said openings adapted to receive therethrough a barrel of a long gun;

d) a latching mechanism locking said lid in a closed position, said latching mechanism having a pivotable latch with a latching tang, said latch further including a further tang opposite said latching tang to weight balance said latch about a pivot point thereof to preclude unauthorized pivoting of said latch; and e) an actuator associated with said latching mechanism for selectively releasing said latching mechanism to permit opening of said lid and access to said compartment.

2. The case of claim 1, wherein said compartment is formed in an insert removably installed in said chamber.

3. The case of claim 1, wherein said openings are formed in said base.

4. The case of claim 1, wherein said base and lid have peripheries that interlock when said lid is closed to preclude misalignment of said lid and base when said lid is closed.

5. The case of claim 4, wherein said base and lid interlock with a tongue and groove connection.

6. The case of claim 1, wherein said actuator includes a keypad on an exterior surface of said housing including a plurality of buttons.

7. The case of claim 6, wherein said keypad is on said lid.

8. The case of claim 6, wherein each button is surrounded by an elongated channel.

9. The case of claim 8, wherein said keypad is on said lid.

10. The case of claim 6, wherein said actuator also includes a key operated lock.

11. The case of claim 1, wherein said latching mechanism includes:

a) said latch mounted in said chamber and pivotable about an axis of rotation thereof;

b) said latching tang receivable in an opening of a strike mounted on said lid to latch said lid closed.

12. The case of claim 11, wherein said latch is S-shaped.

13. The case of claim 11, wherein said latch is biased in a direction of latching.

14. The case of claim 11, wherein said actuator includes an electric motor having a driven shaft, and a cable attached between said driven shaft and said latch, whereby rotation of said driven shaft winds said cable thereon to release said latch.

15. The case of claim 14, wherein said cable is attached to said latch at a pull point laterally offset from said axis of rotation of said latch.

16. The case of claim 11, wherein said actuator includes a key operated lock.

17. The case of claim 16, wherein said lock has a cam rotatable therewith within said chamber and a cable attached between said cam of said lock and said latch, whereby rotation of said lock tightens said cable and releases said latch.

18. The case of claim 17, wherein said cable is attached to said latch at a pull point laterally offset from said axis of rotation of said latch.

19. The case of claim 17, wherein said actuator further includes an electric motor having a driven shaft, and a further cable attached between said driven shaft and said latch, whereby rotation of said driven shaft winds said further cable thereon to release said latch.

20. The case of claim 19, wherein said actuator includes a keypad on an exterior surface of said housing including a plurality of buttons.

21. The case of claim 20, wherein entry of a preset sequence of depressions of said buttons activates said motor.

22. A long gun case, comprising:

a) a housing including a base defining an inner chamber and a closeable lid;

b) said chamber having a compartment shaped in general conformance with an outer configuration of a breech and trigger guard of a long gun, said compartment being formed in an insert removably installed in said chamber;

c) said base having two opposed openings, one of said openings adapted to receive therethrough a stock of a long gun and another of said openings adapted to receive therethrough a barrel of a long gun;

d) a latching mechanism locking said lid in a closed position, said latching mechanism including:

i) a latch mounted in said chamber and pivotable about an axis of rotation thereof;

ii) said latch including a tang receivable in an opening of a strike mounted on said lid to latch said lid closed; and e) actuator means associated with said latching mechanism for selectively releasing said latching mechanism to permit opening of said lid and access to said compartment, said actuator means including an electric motor having a driven shaft, and a cable attached between said driven shaft and said latch, whereby rotation of said driven shaft winds said cable thereon to release said latch, said actuator also including a key operated lock, said lock having a tang rotatable therewith within said chamber and a further cable attached between said tang of said lock and said latch, whereby rotation of said lock tightens said further cable and releases said latch.

23. The case of claim 22, wherein said base and lid have peripheries that interlock in a tongue and groove connection when said lid is closed to preclude misalignment of said lid and base when said lid is closed.

24. The case of claim 22, wherein said actuator includes a keypad on an exterior surface of said lid including a plurality of buttons, wherein each button is surrounded by an elongated channel.

25. The case of claim 22, wherein said latch is S-shaped and is biased in a direction of latching.

26. The case of claim 22, wherein said cable and further cable are attached to said latch at respective pull points laterally offset from said axis of rotation of said latch.

27. The case of claim 24, wherein entry of a preset sequence of depressions of said buttons activates said motor.

28. The case of claim 22, further including a carrying handle.

29. A long gun case, comprising:

a) a housing including an inner chamber with a compartment shaped in general conformance with an outer configuration of a breech and firing mechanism of a long gun;

b) said housing having two opposed openings, one of said openings adapted to receive therethrough a stock of a long gun and another of said openings adapted to receive therethrough a barrel of a long gun;

c) said openings and compartment being sized and configured to preclude removal of a long gun from said housing through said openings;

d) a latching mechanism locking said lid in a closed position;

e) an actuator associated with said latching mechanism for selectively releasing said latching mechanism to permit opening of said lid and access to said compartment;

f) said latching mechanism including:

i) a latch mounted in said chamber and pivotable about an axis of rotation thereof;

ii) said latch including a tang receivable in an opening of a strike mounted on said lid to latch said lid closed.

30. The case of claim 29, wherein said compartment is formed in an insert removably installed in said chamber.

31. The case of claim 29, wherein said housing comprises a base and a closeable lid.

32. The case of claim 31, wherein said compartment is located in said base.

33. The case of claim 31, wherein said openings are formed in said base.

34. The case of claim 29, wherein said actuator includes a keypad on an exterior surface of said housing including a plurality of buttons.

35. The case of claim 29, wherein said actuator includes an electric motor having a driven shaft, and a cable attached between said driven shaft and said latch, whereby rotation of said driven shaft winds said cable thereon to release said latch.

36. The case of claim 35, wherein said actuator includes a key operated lock.

* * * * *